US007156501B2

(12) United States Patent
Hirota et al.

(10) Patent No.: US 7,156,501 B2
(45) Date of Patent: Jan. 2, 2007

(54) INKJET HEAD

(75) Inventors: Atsushi Hirota, Nagoya (JP); Mikio Sakuma, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 192 days.

(21) Appl. No.: 10/913,442

(22) Filed: Aug. 9, 2004

(65) Prior Publication Data

US 2005/0036008 A1 Feb. 17, 2005

(30) Foreign Application Priority Data

Aug. 12, 2003 (JP) ..... 2003-292575

(51) Int. Cl.
*B41J 2/045* (2006.01)

(52) U.S. Cl. ..... 347/68

(58) Field of Classification Search ..... 347/68–72; 29/25.35

See application file for complete search history.

(56) References Cited

U.S. PATENT DOCUMENTS 5,157,420 A 10/1992 Naka et al.
5,757,400 A 5/1998 Hoisington
6,783,214 B1 8/2004 Sakuma
6,984,027 B1 * 1/2006 Sakaida et al. ..... 347/68
2003/0156164 A1 8/2003 Sakaida et al.

FOREIGN PATENT DOCUMENTS

JP A 03-075153 3/1991
JP A 06-226975 8/1994
JP A 07-246701 9/1995
JP A 2003-165213 6/2003

* cited by examiner

*Primary Examiner*—An H. Do
(74) *Attorney, Agent, or Firm*—Oliff & Berridge, PLC

(57) ABSTRACT

Pressure chambers arranged in the form of a matrix along a plane form first and second pressure chamber columns arranged alternately in the plane and having nozzles connected on opposite sides respectively. Two adjacent pressure chamber columns constituted by a first pressure chamber column and a second pressure chamber column are arranged opposite to each common ink path. First connection holes formed in the pressure chambers of the first pressure chamber column and connected to nozzles and second connection holes formed in the pressure chambers of the second pressure chamber column and connected to nozzles are arranged side by side on opposite sides of a corresponding common ink path. Between two adjacent common ink paths, first connection holes and second connection holes are arranged on a column.

15 Claims, 10 Drawing Sheets

INKJET HEAD

BACKGROUND OF THE INVENTION

1. Field of the Invention

The present invention relates to an inkjet head used in an inkjet recording apparatus for ejecting ink onto a recording medium to perform printing.

2. Description of the Related Art

In an inkjet head, ink from an ink tank is supplied to a plurality of pressure chambers through common ink paths. When pulse-like pressure is selectively given to the pressure chambers to generate pressure wave, ink is ejected from nozzles connected to the selected pressure chambers. Of this type inkjet heads, an inkjet head having pressure chambers arranged in the form of a matrix along a head surface has been proposed to achieve higher print resolution and higher print speed (e.g., see Japanese Patent No. 3,231,786 (FIGS. 3 and 4), U.S. Pat. No. 5,757,400 and WO 97/28000).

In the proposed inkjet head, hexagonal pressure chambers are arranged in one direction along a head surface to thereby form pressure chamber columns. Common ink paths for supplying ink to the pressure chambers extend in the direction of arrangement of the pressure chambers. Opposite sides of pressure chambers constituting each pressure chamber column are partially opposite to two common ink paths respectively when viewed from a direction perpendicular to the head surface. Nozzles are arranged in central portions of the pressure chambers respectively when viewed from the direction perpendicular to the head surface. Ink is supplied from common ink paths on opposite sides of the pressure chambers into the pressure chambers. The ink is ejected from the nozzles located in the central portions of the pressure chambers.

In the inkjet head described in Japanese Patent No. 3,231,786, the distance between nozzles in two adjacent pressure chamber columns is however made large because the nozzles are arranged in central portions of the pressure chambers respectively. The nozzles for ejecting ink need to be arranged in positions not overlapping the common ink paths when viewed from the direction perpendicular to the head surface. If the nozzles are arranged in this manner, the width of common ink paths disposed on opposite sides of each pressure chamber column is limited. If the width of common ink paths is limited in this manner, the flow path area of the common ink paths is inevitably narrowed. For this reason,the flow path resistance of the common ink paths increases, so that ink cannot be smoothly supplied to the pressure chambers. Or the height of each common ink path must be made large in order to increase the flow path area of the common ink paths. As a result, the size of the head increases.

SUMMARY OF THE INVENTION

It is an object of the invention to provide an inkjet head having pressure chambers and nozzles arranged so that the width of each common ink path can be made as large as possible.

According to one aspect of the invention, an inkjet head including: a flow path unit including; plural nozzles which ejects ink; plural pressure chambers having ends connected the nozzles respectively, which are arranged in a form of a matrix along a plane to thereby form pressure chamber columns in a first direction in the plane, the plural pressure chambers including; first pressure chamber columns, each including pressure chambers having the nozzles unevenly distributed on one side of a second direction crossing the first direction and first connection holes connected to the nozzles respectively; and second pressure chamber columns, each including pressure chambers having the nozzles unevenly distributed on the other side of the second direction and second connection holes connected to the nozzles respectively; and plural common ink paths extending along the first direction and connected to the pressure chambers through ink inlets respectively, wherein the first and second pressure chamber columns are arranged alternately in the plane, two pressure chamber columns are arranged opposite to each of the common ink paths and configured by one of the first pressure chamber columns and one of the second pressure chamber columns which are adjacent with each other, the first connection holes and the second connection holes are arranged side by side in the first direction on opposite sides of a corresponding common ink path when viewed from a third direction perpendicular to the plane, and the first connection holes and the second connection holes are arranged and at least partially overlapped each other between two adjacent common ink paths when viewed from the first direction.

In the inkjet head, the common ink paths extending in the first direction supply ink to the pressure chambers through ink inlets. Ink is ejected from nozzles connected to ends of the pressure chambers through connection holes respectively. The pressure chambers form pressure chamber columns extending in the first direction. The pressure chamber columns include first pressure chamber columns having nozzles unevenly distributed on one side of the second direction crossing the first direction, and second pressure chamber columns having nozzles unevenly distributed on the other side of the second direction. That is, the positions of nozzles connected to pressure chambers constituting a first pressure chamber column are reverse to the positions of nozzles connected to pressure chambers constituting a second pressure chamber column with respect to the second direction. Two adjacent pressure chamber columns constituted by a combination of a first pressure chamber column and a second pressure chamber column are arranged opposite to each common ink path. In this manner, all the pressure chambers constituting the first and second pressure chamber columns are opposite to each common ink path. Accordingly, the difference in compliance (reciprocal of rigidity) between pressure chambers belonging to the first pressure chamber column and pressure chambers belonging to the second pressure chamber column can be reduced when ink is ejected from nozzles connected to the pressure cambers. Accordingly, ink ejection characteristic such as ink droplet shape and ink ejection speed can be made uniform when ink is ejected from nozzles connected to the pressure chambers respectively.

The nozzles for ejecting ink need to be arranged in positions not overlapping the common ink path corresponding to the pressure chambers having the nozzles connected thereto when viewed from the third direction. Therefore, first connection holes formed in the pressure chambers constituting the first pressure chamber column and connected to nozzles respectively and second connection holes formed in the pressure chambers constituting the second pressure chamber column and connected to nozzles respectively are arranged side by side in the first direction on opposite sides of a corresponding common ink path when viewed from the third direction. Moreover, between two adjacent common ink paths, the first connection holes and the second connection holes are arranged so as to partially overlap each other when viewed from the first direction.

That is, the region occupied by the first and second connection holes can be made as narrow as possible in the second direction to reduce the distance between nozzles in the second direction to thereby widen the common ink paths. Accordingly, the flow path area of the common ink paths can be made large and the flow path resistance of the common ink paths can be reduced so that ink can be smoothly supplied to the pressure chambers. Or the height (length in the third direction) of each common ink path can be reduced as the width of each common ink path is reduced. Accordingly, the size of the inkjet head can be reduced.

According to another aspect of the invention, the first connection holes and the second connection holes are arranged on one column in the first direction between the two adjacent common ink paths in the inkjet. Accordingly, the region occupied by the first and second connection holes can be made narrower in the second direction, so that the common ink paths can be made wider.

According to another aspect of the invention, an inkjet head including: a flow path unit including; plural nozzles which ejects ink; plural pressure chambers having ends connected to the nozzles respectively and arranged in the form of a matrix along a plane to thereby form pressure chamber columns in the first direction in the plane; and plural common ink paths extending along the first direction and connected to the pressure chambers through plural ink inlets respectively, wherein the pressure chamber columns include first pressure chamber columns each configured by pressure chambers having nozzles unevenly distributed on one side of a second direction crossing the first direction and second pressure chamber columns each configured by pressure chambers having nozzles unevenly distributed on the other side of the second direction, the first and second pressure chamber columns are arranged alternately in the plane, two adjacent pressure chamber columns are configured by a combination of one of the first pressure chamber columns and one of the second pressure chamber columns which are arranged opposite to each of the common ink paths, plural nozzles connected to pressure chambers of the first pressure chamber columns and plural nozzles connected to pressure chambers of the second pressure chamber columns are arranged side by side in the first direction on opposite side of corresponding common ink paths when viewed from a third direction perpendicular to the plane; and first ink flow paths connecting the pressure chambers of the first pressure chamber columns to the nozzles respectively and second ink flow paths connecting the pressure chambers of the second pressure chamber columns to the nozzles respectively are arranged and at least partially overlapped each other between two adjacent common ink paths when viewed from the first direction.

Thus, the nozzles of the first pressure chamber column and nozzles of the second pressure chamber column are arranged side by side in the first direction on opposite sides of each common ink path. First ink flow paths for connecting pressure chambers of the first pressure chamber column to nozzles respectively and second ink flow paths for connecting pressure chambers of the second pressure chamber column to nozzles respectively are arranged so as to partially overlap each other when viewed from the first direction. Accordingly, the region occupied by the first and second ink flow paths can be narrowed in the second direction, so that the common ink paths can be widened.

According to another aspect of the invention, the first ink flow paths and the second ink flow paths are arranged on one column in the first direction between the two adjacent common ink paths. Accordingly, the region occupied by the first and second ink flow paths can be made narrower in the second direction, so that the common ink paths can be widened more greatly.

According to another aspect of the invention, an inkjet head including: a flow path unit including; plural nozzles which ejects ink; plural pressure chambers having ends connected to the nozzles respectively and arranged in the form of a matrix along a plane to thereby form pressure chamber columns in a first direction in the plane; and plural common ink paths extending along the first direction and connected to the pressure chambers through ink inlets respectively, wherein the pressure chamber columns include first pressure chamber columns each configured by pressure chambers having nozzles unevenly distributed on one side of a second direction crossing the first direction, and second pressure chamber columns each configured by pressure chambers having nozzles unevenly distributed on the other side of the second direction, the first and second pressure chamber columns are arranged alternately in the plane, two adjacent pressure chamber columns configured by a combination of a first pressure chamber column and a second pressure chamber column are arranged opposite to each common ink path, plural first ink inlets formed in the pressure chambers of the first pressure chamber columns and plural second ink inlets formed in the pressure chambers of the second pressure chamber columns are arranged side by side and opposite to nozzles connected to corresponding pressure chambers when viewed from a third direction perpendicular to the plane, and each of the common ink paths is formed so that the first ink inlets of the first pressure chamber columns and the second ink inlets of the second pressure chamber columns are arranged and partially overlapped each other in a neighbor of a central portion of the common ink paths viewed from the third direction when viewed from the first direction.

Thus, first ink inlets formed in the pressure chambers belonging to the first pressure chamber column and second ink inlets formed in the pressure chambers belonging to the second pressure chamber column are arranged side by side and opposite to nozzles connected to corresponding pressure chambers when viewed from the third direction. Moreover, the first ink inlets of the first pressure chamber column and the second ink inlets of the second pressure chamber column are arranged so as to partially overlap each other in a neighbor of a central portion of the common ink path when viewed from the first direction. Accordingly, the distance between nozzles of the first and second pressure chamber columns disposed on opposite sides of the common ink path can be made large, so that the common ink path disposed between the first and second pressure chamber columns can be widened.

According to another aspect of the invention, each of the common ink paths is formed so that the first ink inlets and the second ink inlets are arranged on one column in the first direction in a neighbor of a central portion of the common ink paths viewed from the third direction. Accordingly, the distance between nozzles of the first and second pressure chamber columns disposed on opposite sides of the common ink path can be made larger, so that the common ink path can be widened more greatly.

According to another aspect of the invention, the direction of flow of ink supplied from the common ink path to the pressure chambers is inclined at an acute angle with respect to the direction of flow of ink in the common ink path when viewed from the third direction. Accordingly, ink smoothly flows from the common ink path to the pressure chambers, so that ink can be smoothly supplied to the pressure chambers. In addition, air mixed with ink in the common ink path smoothly flows into the pressure chambers, so that air reserved in the inside of the common ink path, etc. can be discharged easily.

According to another aspect of the invention, the pressure chambers and the common ink paths are connected to each other through apertures extending in parallel to the plane. Each of the common ink paths is formed so that first apertures connected to pressure chambers of the first pressure chamber columns and second apertures connected to pressure chambers of the second pressure chamber columns are arranged symmetrically with respect to points when viewed from the third direction. Accordingly, a flow path structure for supplying ink from the common ink path to pressure chambers constituting the first pressure chamber column and a flow path structure for supplying ink from the common ink path to pressure chambers constituting the second pressure chamber column are formed symmetrically with respect to a point, so that ink supply characteristic and mixed air discharge characteristic can be made uniform to the first and second pressure chamber columns.

According to another aspect of the invention, an inkjet head including: a flow path unit including; plural nozzles which ejects ink; plural pressure chambers having ends connected the nozzles respectively, which are arranged in a form of a matrix along a plane to thereby form pressure chamber columns in a first direction in the plane, the plural pressure chambers including; first pressure chamber columns, each including pressure chambers having the nozzles unevenly distributed on one side of a second direction crossing the first direction and first connection holes connected to the nozzles respectively; and second pressure chamber columns, each including pressure chambers having the nozzles unevenly distributed on the other side of the second direction and second connection holes connected to the nozzles respectively; and plural common ink paths extending along the first direction and connected to the pressure chambers through ink inlets respectively, wherein the first and second pressure chamber columns are arranged alternately in the plane, two pressure chamber columns are arranged opposite to each of the common ink paths and configured by one of the first pressure chamber columns and one of the second pressure chamber columns which are adjacent with each other, the first connection holes and the second connection holes are arranged side by side in the first direction on opposite sides of a corresponding common ink path when viewed from a third direction perpendicular to the plane, and a portion where the pressure chambers of the first pressure chamber columns overlap with one of the common ink paths with respect to each of the common ink paths has substantially same area as a portion where the pressure chambers of the second pressure chamber columns overlap with the one of the common ink paths with respect to each of the common ink paths when viewed from a direction which is orthogonal to the plane.

According to another aspect of the invention, an inkjet head including; a flow path unit including; plural nozzles which ejects ink; plural pressure chambers having ends connected the nozzles respectively, which are arranged in a form of a matrix along a plane to thereby form pressure chamber columns in a first direction in the plane, the plural pressure chambers including; first pressure chamber columns, each including pressure chambers having the nozzles unevenly distributed on one side of a second direction crossing the first direction and first connection holes connected to the nozzles respectively; and second pressure chamber columns, each including pressure chambers having the nozzles unevenly distributed on the other side of the second direction and second connection holes connected to the nozzles respectively; and plural common ink paths extending along the first direction and connected to the pressure chambers through ink inlets respectively, wherein the first and second pressure chamber columns are arranged alternately in the plane, two pressure chamber columns are arranged opposite to each of the common ink paths and configured by one of the first pressure chamber columns and one of the second pressure chamber columns which are adjacent with each other, the first connection holes and the second connection holes are arranged side by side in the first direction on opposite sides of a corresponding common ink path when viewed from a third direction perpendicular to the plane, and a portion where each of the pressure chambers overlaps with each of the common ink paths is larger than a portion where each of the pressure chambers does not overlap with each of the common ink paths.

DESCRIPTION OF THE PREFERRED EMBODIMENTS

Figure 1:
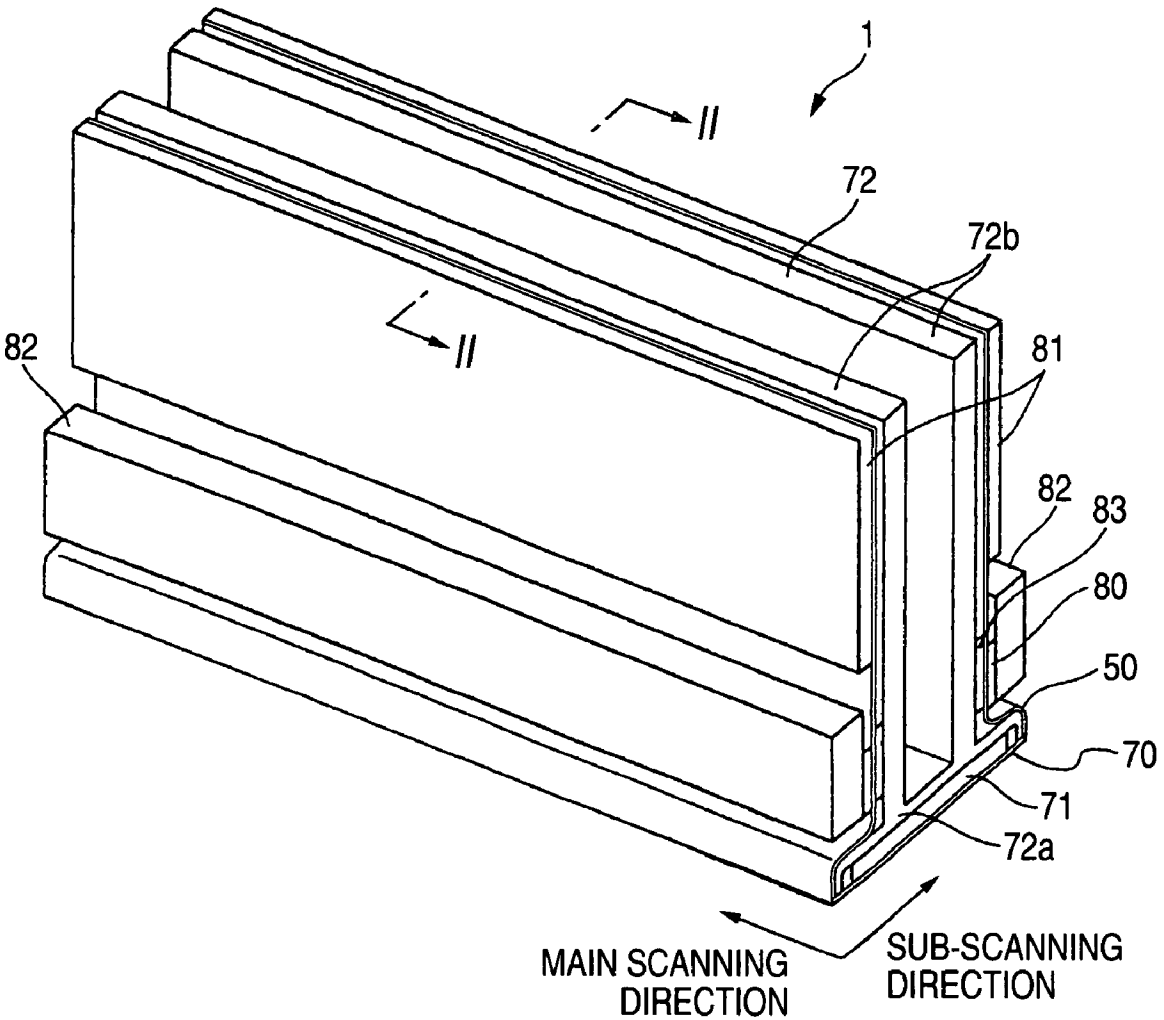
FIG. 1 is a perspective view of an inkjet head according to a first embodiment of the invention.
Figure 2:
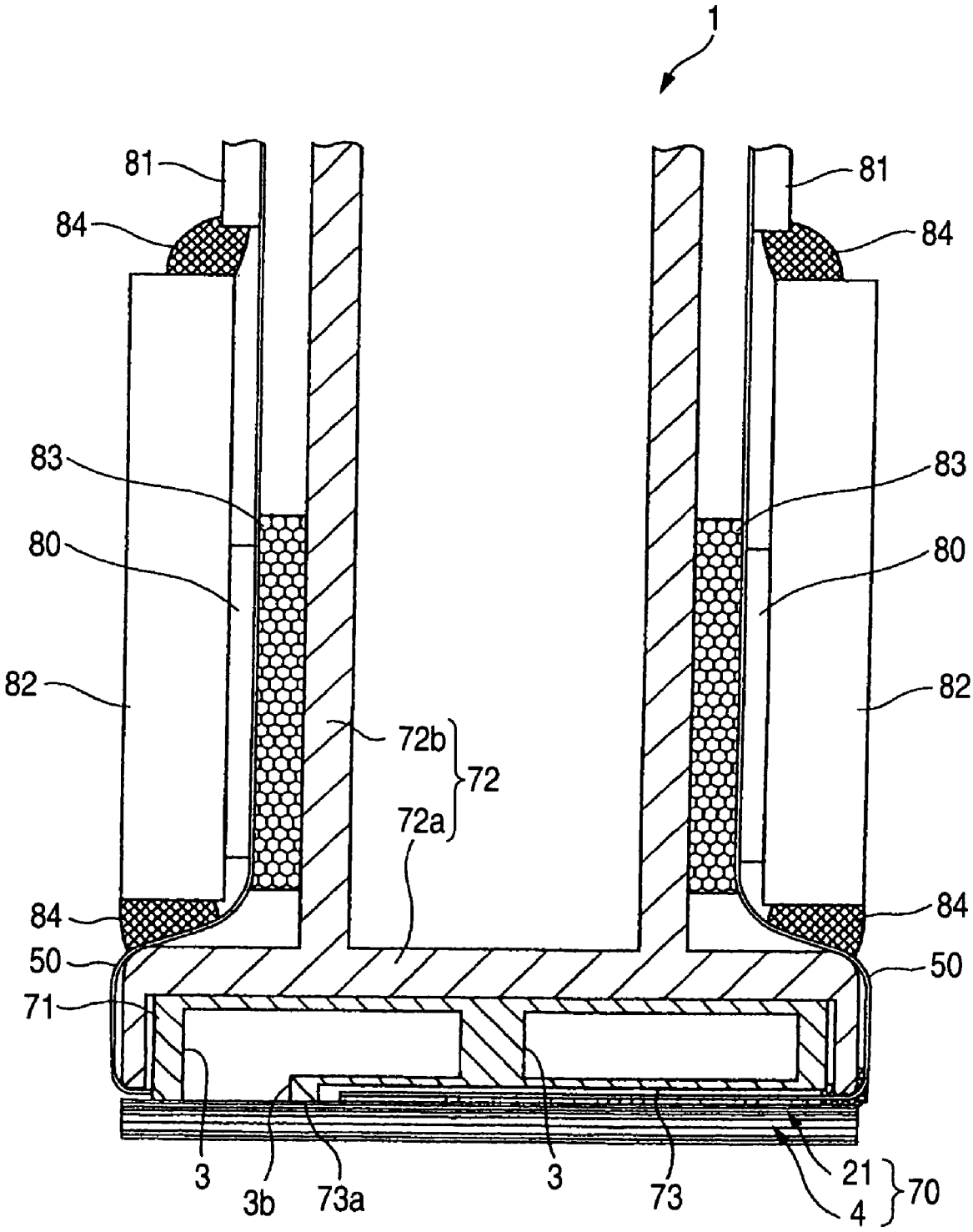
FIG. 2 is a sectional view taken along the line II—II in FIG. 1.

A first embodiment of the invention will be described. As shown in FIGS. 1 and 2, an inkjet head 1 according to the first embodiment has a head body 70, and a base block 71. The head body 70 extends in a main scanning direction so as to be shaped like a rectangle in plan view for ejecting ink onto a sheet of paper. The base block 71 is arranged above the head body 70 and includes two ink reservoirs 3 which are flow paths of ink supplied to the head body 70.

The head body 70 includes a flow path unit 4, and actuator units 21. The flow path unit 4 has ink flow paths formed therein. The actuator units 21 are bonded to an upper surface of the flow path unit 4. Each of the flow path unit 4 and the actuator units 21 is formed in such a manner that thin plates are laminated and bonded to one another. Flexible printed circuit boards (hereinafter referred to as FPCs) 50 which are power feeding members are bonded to an upper surface of the actuator units 21 so as to be led to the left and right respectively. The base block 71 is made of a metal material such as stainless steel. The ink reservoirs 3 in the base block 71 are nearly rectangular parallelepiped hollow regions formed along a direction of the length of the base block 71.

A lower surface 73 of the base block 71 protrudes downward from its surroundings in neighbors of openings 3*b*. Only at portions 73*a* near the openings 3*b* of the lower surface 73, the base block 71 comes into contact with the flow path unit 4. Therefore, other regions than the portions 73*a* near the openings 3*b* of the lower surface 73 of the base block 71 are isolated from the head body 70. The actuator units 21 are disposed in the isolated portions.

The base block 71 is bonded and fixed into a cavity formed in a lower surface of a grip portion 72*a* of a holder 72. The holder 72 includes a grip portion 72*a*, and a pair of flat plate-shaped protrusions 72*b* extending from an upper surface of the grip portion 72*a* so as to be disposed in a direction perpendicular to the upper surface of the grip portion 72*a* and at a predetermined distance from each other. The FPCs 50 bonded to the actuator units 21 are disposed along surfaces of the protrusions 72*b* of the holder 72 through elastic members 83 such as sponge respectively. Driver ICs 80 are arranged on the FPCs 50 disposed along the surfaces of the protrusions 72*b* of the holder 72 respectively. The FPCs 50 are electrically connected to the driver ICs 80 and the actuator units 21 (which will be described later) of the head body 70 by means of soldering so that drive signals output from the driver ICs 80 are transmitted to the actuator units 21.

Nearly rectangular parallelepiped heat sinks 82 are disposed on outer surfaces of the driver ICs 80 so as to adhere closely to the driver ICs 80, so that heat generated in the driver ICs 80 can be radiated out efficiently. Boards 81 are disposed above the driver ICs 80 and the heat sinks 82 and outside the FPCs 50. Upper surfaces of the heat sinks 82 are bonded to the boards 81 by seal members 84 respectively. Lower surfaces of the heat sinks 82 are bonded to the FPCs 50 by seal members 84 respectively.

Figure 3:
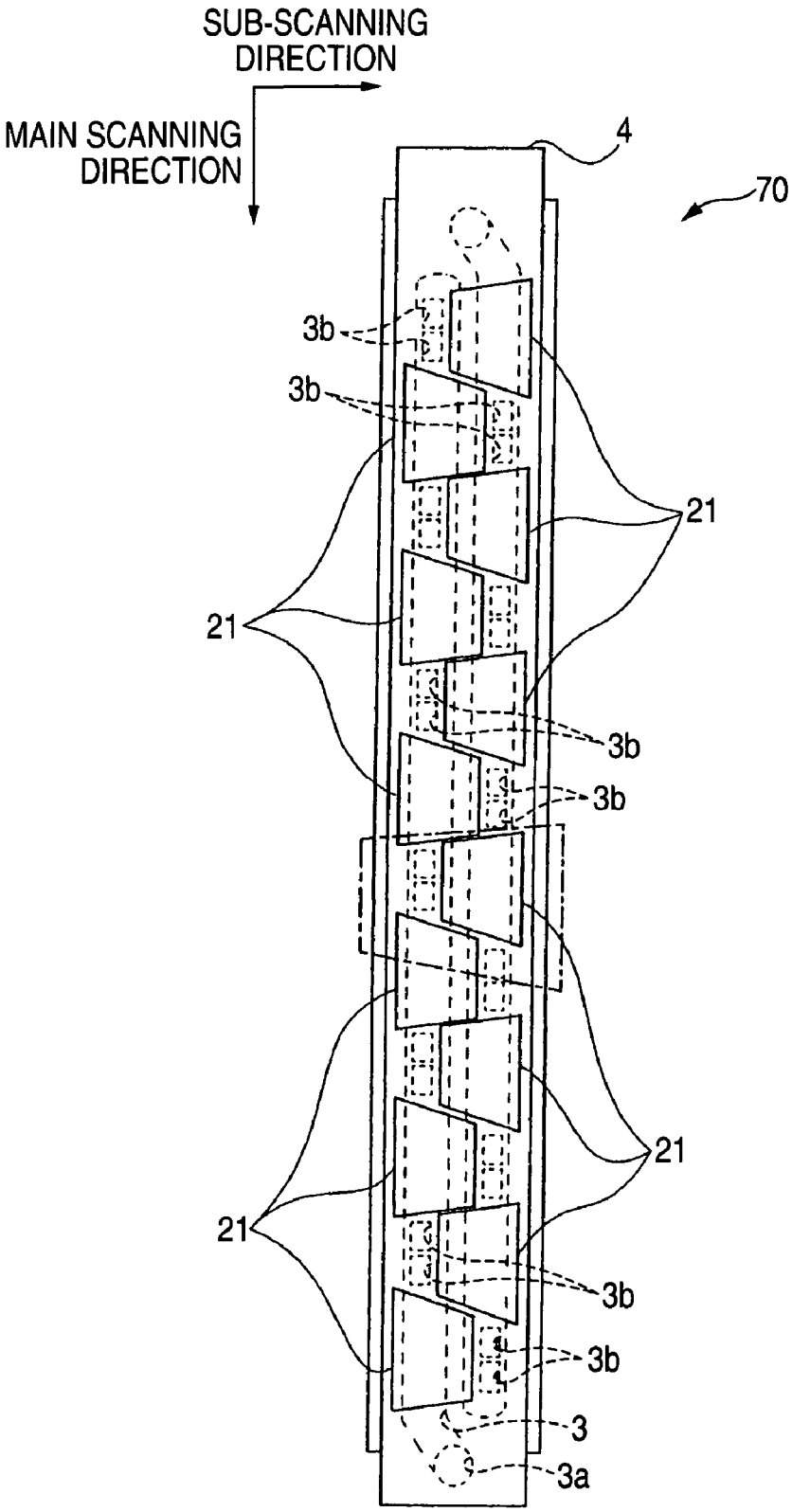
FIG. 3 is a plan view of a head body.

FIG. 3 is a plan view of the head body 70 depicted in FIG. 1. The ink reservoirs 3 formed in the base block 71 are virtually expressed by the broken line in FIG. 3. The two ink reservoirs 3 extend in parallel to each other along the direction of the length of the head body 70 so as to be disposed at a predetermined distance from each other. Each ink reservoir 3 has an opening 3*a* at its one end. The two ink reservoirs 3 are connected to an ink tank (not shown) through the openings 3*a* respectively, so that the two ink reservoirs 3 are always filled with ink. Each ink reservoir 3 further has a large number of openings 3*b* provided along the lengthwise direction of the head body 70, so that each ink reservoir is connected to the flow path unit 4 as described above. The large number of openings 3*b* are formed so that each pair of openings 3*b* are disposed adjacently along the lengthwise direction of the head body 70. Pairs of openings 3*b* connected to one ink reservoir 3 and pairs of openings 3*b* connected to the other ink reservoir 3 are arranged in zigzag.

The actuator units 21 each shaped like a trapezoid in plan view are provided in regions in which the openings 3*b* are not disposed. The actuator units 21 are arranged in zigzag in a pattern reverse to that of the pairs of openings 3*b*. Parallel opposed sides (upper and lower sides) of each actuator unit 21 are parallel to the lengthwise direction of the head body 70. Hypotenuses of adjacent actuator units 21 partially overlap each other in the widthwise direction of the head body 70.

Figure 4:
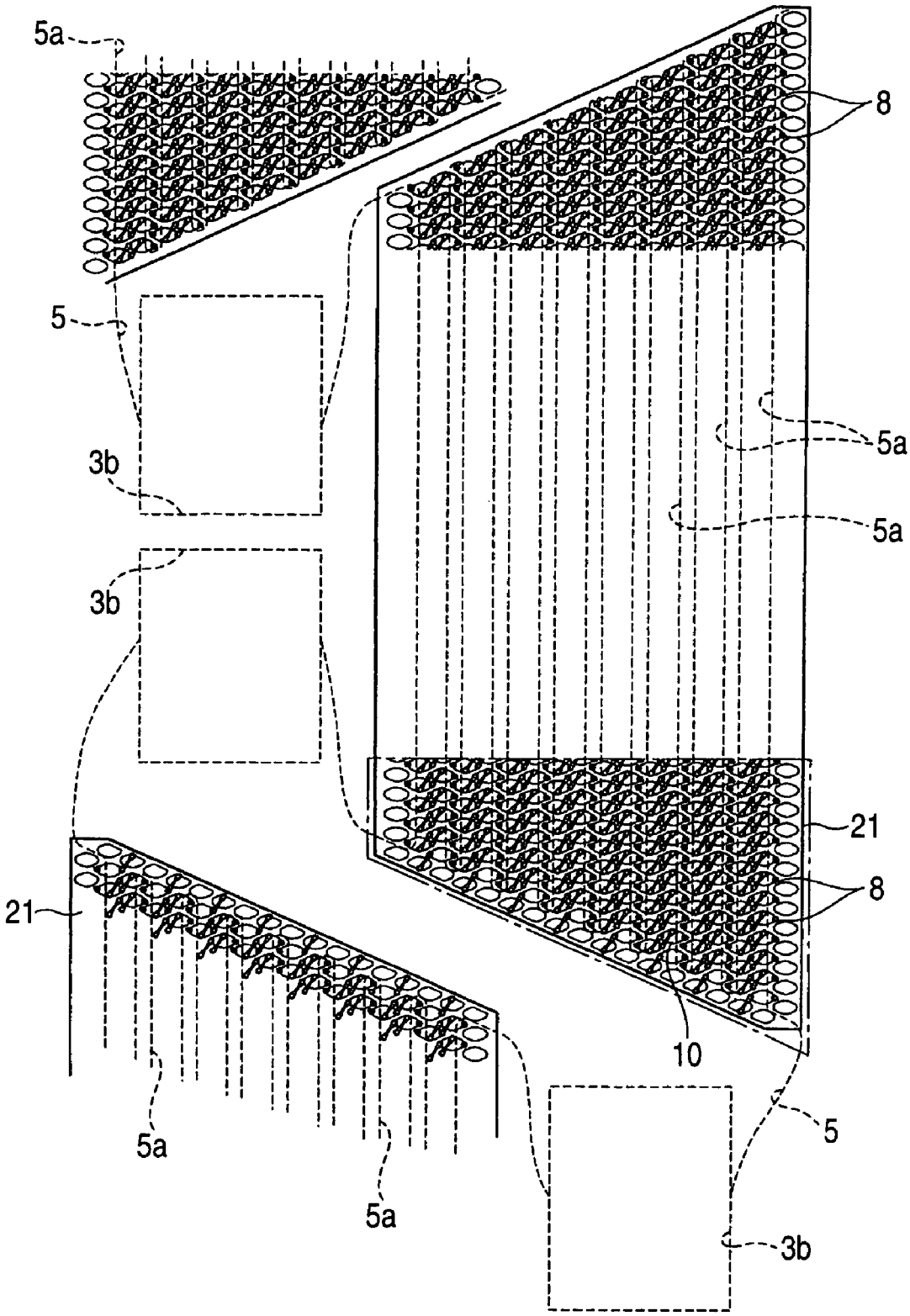
FIG. 4 is an enlarged view of a region surrounded by the chain line in FIG. 3.

FIG. 4 is an enlarged view of a region surrounded by the chain line in FIG. 3. As shown in FIG. 4, the openings 3*b* provided in each ink reservoir 3 are connected to manifolds 5 respectively. An end portion of each manifold 5 is separated into sub manifolds 5*a* which are common ink paths. That is, eight sub manifolds 5*a* in total are provided below each actuator unit 21 so that the eight sub manifolds 5*a* extend along parallel opposed sides of the actuator unit 21 while isolated from one another. A lower surface of the flow path unit 4 corresponding to a bonding region of the actuator unit 21 is formed as an ink ejection region. As will be described later, a large number of nozzles 8 and pressure chambers 10 are arranged in the form of a matrix on a surface of the ink ejection region.

Figure 5:
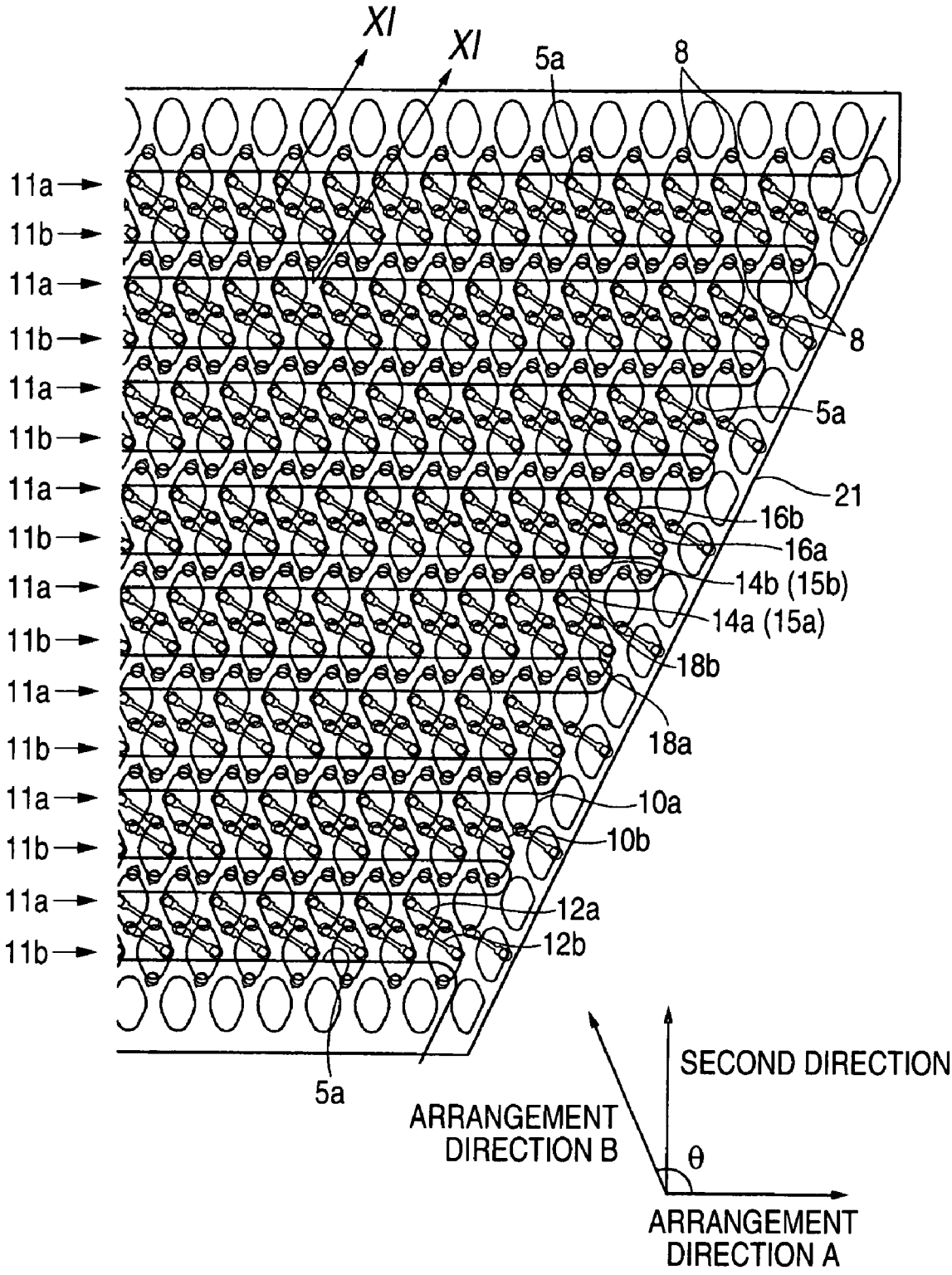
FIG. 5 is an enlarged view of a region surrounded by the chain line in FIG. 4.

FIG. 5 is an enlarged view of a region surrounded by the chain line in FIG. 4. FIGS. 4 and 5 show a state in which a plane on which a large number of pressure chambers 10 in the flow path unit 4 are arranged in the form of a matrix is viewed from a direction perpendicular to the ink ejection surface. Each pressure chamber 10 is substantially shaped like a rhomboid having rounded corners in plan view. The pressure chambers 10 are arranged in the form of a matrix in two arrangement directions A (first direction) and B so adjacently that the pressure chambers 10 do not overlap one another. The arrangement direction A is a direction of the length of the inkjet head 1, that is, a direction of extension of the sub manifolds 5*a*. The arrangement direction A is parallel to a short diagonal line of each pressure chamber 10. The arrangement direction B is a direction which forms an obtuse angle with respect to the arrangement direction A.

Figure 6:
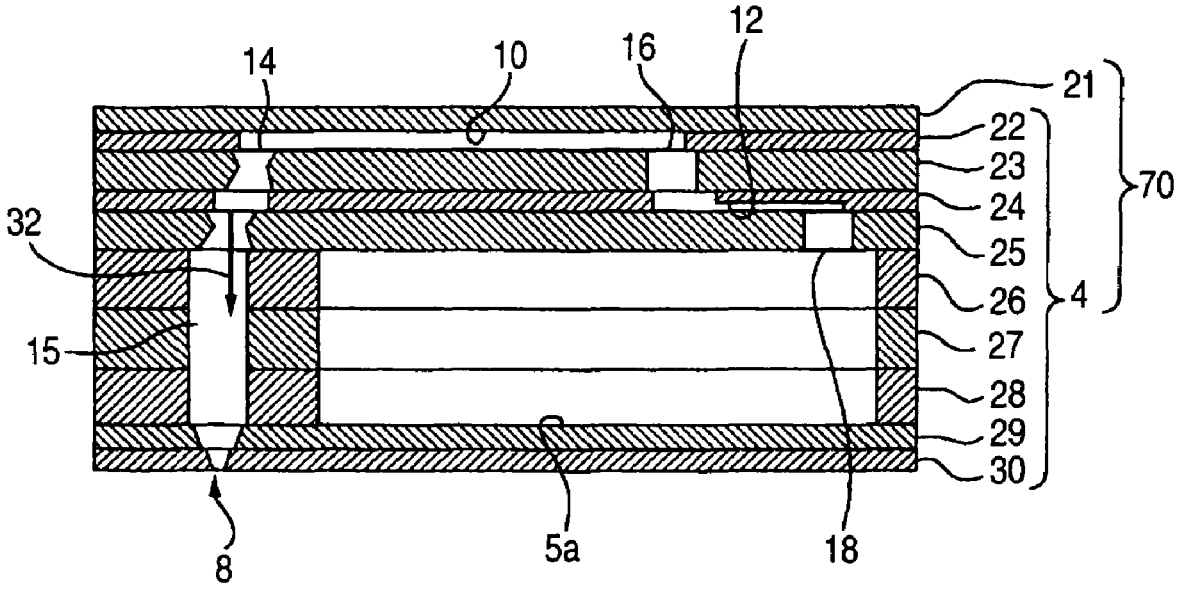
FIG. 6 is a sectional view taken along the line XI—XI in FIG. 5.

A direction (second direction) of a long diagonal line of each pressure chamber 10 is perpendicular to the arrangement direction A (first direction) and parallel to a direction of the width of the flow path unit 4. As shown in FIGS. 5 and 6, each pressure chamber 10 has one end connected to a nozzle 8 through a connection hole 14 (14*a*, 14*b*) and the other end connected to a sub manifold 5*a* as a common ink path through an ink inlet 16 (16*a*, 16*b*) and an aperture 12 (12*a*, 12*b*). Though not shown in FIG. 5, individual electrodes 35 (see FIG. 8) are formed on the actuator unit 21 so as to overlap the pressure chambers 10 respectively in plan view. Each individual electrode 35 is similar in shape to the pressure chamber 10 but smaller by a size than the pressure chamber 10. Incidentally, the sub manifolds 5*a*, pressure chambers 10, apertures 12, etc. that must be expressed by the broken line in the actuator units 21 or in the flow path unit 4 are expressed by the solid line in FIGS. 4 and 5 to make it easy to understand the drawings.

The pressure chambers 10 are disposed at intervals of a distance corresponding to 37.5 dpi along the arrangement direction A. The pressure chambers 10 form a plurality of pressure chamber columns 11 extending in the arrangement direction A. Incidentally, pressure chambers 10 located at opposite ends in the arrangement direction B are dummy chambers that do not contribute to ink ejection.

The pressure chamber columns 11 are classified into first pressure chamber columns 11*a* and second pressure chamber columns 11*b*. Each first pressure chamber column 11*a* includes pressure chambers 11*a* having nozzles 8 unevenly distributed on one side (upper side in FIG. 5) in the second direction. Each second pressure chamber column 11*b* includes pressure chambers 10*b* having nozzles 8 unevenly distributed on the other side (lower side in FIG. 5) in the second direction. These first and second pressure chamber columns 11*a* and 11*b* are arranged alternately in a plane. A region about ⅔ as large as pressure chambers 10*a* and 10*b* which are constituent members of two pressure chamber columns 11*a* and 11*b* adjacent to each other overlaps one sub manifold 5*a* when viewed from a direction (third direction) perpendicular to the plane in which the pressure chambers 10 are arranged. That is, the region is opposite to the submanifold 5*a*. In this manner, pressure chambers 10*a* as constituent members of a first pressure chamber column 11*a* and pressure chambers 10*b* as constituent members of a second pressure chamber column 11*b* adjacent to the first pressure chamber column 11*a* are arranged opposite to one sub manifold 5*a* with an equal area overlapping the sub-manifold 5*a*. Accordingly, the stereoscopic positional relation of the pressure chambers 10*a* and 10*b* with the sub manifold 5*a* or constituent members of other flow paths can be kept substantially constant. Accordingly, any one of pressure chambers 10*a* and 10*b* can be disposed in a structure having effectively equal rigidity. That is, the difference in compliance between the pressure chambers 10*a* and 10*b* can be reduced when ink is ejected from the nozzles 8. Ink ejection characteristic such as ink droplet shape and ejection speed of ink ejected from the nozzles 8 connected to the pressure chambers 10*a* and 10*b* can be made uniform.

Connection holes 14 (14*a* and 14*b*) connected to the nozzles 8 respectively are formed in the residual region which does not overlap the sub manifold 5*a* and which is about ⅓ as large as the pressure chambers 10*a* and 10*b*. As will be described next, the connection holes 14 are connected to the nozzles 8 through ink flow paths 15 (15*a* and 15*b*) extending in the third direction.

Each individual ink flow path 32 for leading ink from a sub manifold 5*a* to a nozzle 8 through a pressure chamber 10 will be described below. As shown in FIGS. 5 and 6, in each individual ink flow path 32, a sub manifold 5*a* is connected from an ink outlet 18 to a pressure chamber 10 through an aperture 12 and an ink inlet 16. The pressure chamber 10 is connected to a nozzle 8 through a connection hole 14 and an ink flow path 15 extending in the third direction. Each individual ink flow path 32 is formed so that one sub manifold 5*a* supplies ink to a plurality of pressure chambers 10*a* and 10*b* as constituent members of first and second pressure chamber columns 11*a* and 11*b* opposite to the sub manifold 5*a*.

As described above, the flow path unit 4 is formed so that one sub manifold 5*a* supplies ink to only the plurality of pressure chambers 10*a* and 10*b* as constituent members of two pressure chamber columns 11*a* and 11*b*. Accordingly, the density of ink outlets 18 (18*a* and 18*b*) formed in the sub manifold 5*a* or the density of apertures 12 connected to the ink outlets 18 can be relaxed compared with the case where one sub manifold 5*a* supplies ink to three or more pressure chamber columns (e.g., four pressure chamber columns). Accordingly, the degree of freedom on design for arranging the ink outlets 18, apertures, etc. can be improved. Moreover, when ink is ejected from a nozzle 8 connected to one pressure chamber 10, the influence of pressure change of the sub manifold 5*a* on ink ejection characteristic of another pressure chamber 10, that is, so-called crosstalk can be reduced.

Figure 7:
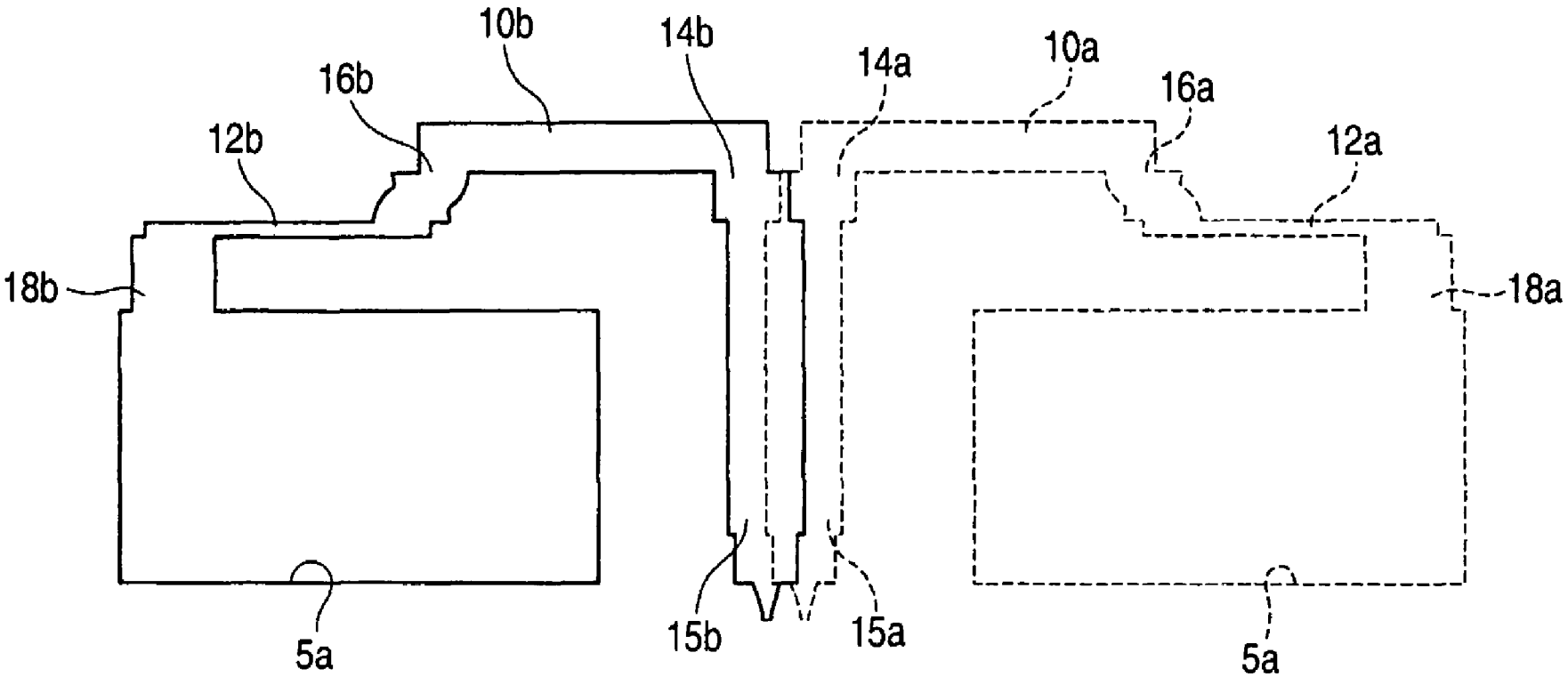
FIG. 7 is a sectional view schematically showing sub manifolds and individual ink flow paths for pressure chambers of first and second pressure chamber columns.

Incidentally, as shown in FIG. 5, first connection holes 14*a* formed in pressure chambers 10*a* as constituent members of a first pressure chamber column 11*a* and second connection holes 14*b* formed in pressure chambers 10*b* as constituent members of a second pressure chamber column 11*b* adjacent to the first pressure chamber column 11*a* are arranged side by side in the first direction on opposite sides of a sub manifold 5*a* when viewed from the third direction. As shown in FIGS. 5 and 7, a plurality of first connection holes 14*a* and a plurality of second connection holes 14*b* partially overlap each other between adjacent two sub manifolds 5*a* when viewed from the first direction, so that the plurality of first connection holes 14*a* and the plurality of second connection holes 14*b* are substantially arranged on a column in the first direction. First ink flow paths 15*a* connected to the pressure chambers 10*a* as constituent members of the first pressure chamber column 11*a* and second ink flow paths 15*b* connected to the pressure chambers 10*b* as constituent members of the second pressure chamber column 11*b* also partially overlap each other when viewed from the first direction, so that the first ink flow paths 15*a* and the second ink flow paths 15*b* are substantially arranged on a column in the first direction.

According to this configuration, the region occupied by the first and second connection holes 14*a* and 14*b* (first and second ink flow paths 15*a* and 15*b*) can be made as narrow as possible in the second direction to reduce the distance between nozzles 8 in the second direction to thereby widen the sub manifolds 5*a* in the third direction. Accordingly, the flow path area of each sub manifold 5*a* can be reduced and flow path resistance can be reduced, so that ink can be smoothly supplied to the pressure chambers 10. Or the height (the length in the third direction) of each sub manifold 5*a* can be reduced as the sub manifold 5*a* is widened, so that the size of the inkjet head 1 can be reduced.

Moreover, the first ink inlets 16*a* formed in the pressure chambers 10*a* as constituent members of the first pressure chamber column 11*a* and the second ink inlets 16*b* formed in the pressure chambers 10*b* as constituent members of the second pressure chamber column 11*b* are arranged side by side and opposite to corresponding nozzles 8 connected to the pressure chambers 10*a* and 10*b* when viewed from the third direction. The first ink inlets 16*a* and the second ink inlets 16*b* partially overlap each other when viewed from the first direction. The first ink inlets 16*a* and the second ink inlets 16*b* are substantially arranged on a column in the first direction in a neighbor of a central portion of the sub manifold viewed from the third direction. Accordingly, the distance between nozzles 8 of the first and second pressure chamber columns 11*a* and 11*b* disposed on opposite sides of the sub manifold 5*a* can be made large, so that the sub manifold 5*a* disposed between the first and second pressure chamber columns 11*a* and 11*b* can be widened.

As shown in FIG. 6, each pressure chamber 10 and a corresponding aperture 12 are provided with different depths in a direction of lamination of a plurality of thin plates. Accordingly, as shown in FIG. 5, in the flow path unit 4 corresponding to an ink ejection region below the actuator unit 21, an aperture 12 connected to one pressure chamber 10 can be disposed so as to overlap another pressure chamber 10 adjacent to the pressure chamber in the same position in plan view. As a result, pressure chambers 10 can be arranged so densely as to adhere closely to one another. Accordingly, printing of a high-resolution image can be achieved by the inkjet head 1 though the area occupied by the inkjet head 1 is relatively small.

As shown in FIG. 5, a first aperture 12*a* connected to one of pressure chambers 10*a* belonging to a first pressure chamber column 11*a* and a second aperture 12*b* connected to corresponding one of pressure chambers 10*b* belonging to a second pressure chamber column 11*b* adjacent to the first pressure chamber column 11*a* are arranged symmetrically with respect to a point when viewed from the third direction. Accordingly, a flow path structure for supplying ink from the sub manifold 5*a* to one of pressure chambers 10*a* belonging to the first pressure chamber column 11*a* and a flow path structure for supplying ink from the sub manifold 5*a* to corresponding one of pressure chambers 10*b* belonging to the second pressure chamber column 11*b* are formed symmetrically with respect to a point. Accordingly, ink supply characteristic or mixed air discharge characteristic of the first pressure chamber column 11*a* and the second pressure chamber column 11*b* can be made uniform.

Incidentally, as shown in FIGS. 6 and 7, the head body 70 has a laminated structure in which ten sheet members in total, namely, an actuator unit 21, a cavity plate 22, a base plate 23, an aperture plate 24, a supply plate 25, manifold plates 26, 27 and 28, a cover plate 29 and a nozzle plate 30 are laminated on one another. The ten sheet members except the actuator unit 21, that is, nine plates form the flow path unit 4.

As will be described later in detail, the actuator unit 21 includes a laminate of four piezoelectric sheets 41 to 44 (see FIG. 8A) as four layers, and electrodes disposed so that only the uppermost layer is provided as a layer having a portion serving as an active layer at the time of application of electric field while the residual three layers are provided as non-active layers. The cavity plate 22 is a metal plate which has nearly rhomboid openings corresponding to the pressure chambers 10, and first and second ink inlets 16*a* and 16*b* and first and second connection holes 14*a* and 14*b* connected to the openings. The base plate 23 is a metal plate which has holes each for connecting one pressure chamber 10 of the cavity plate 22 to a corresponding aperture 12, and holes each for connecting the pressure chamber 10 to a corresponding nozzle 8. The aperture plate 24 is a metal plate which has apertures 12 each formed as a combination of two holes and a half etching region for connecting the two holes to each other in one pressure chamber 10 of the cavity plate 22, and holes each for connecting the pressure chamber 10 to a corresponding nozzle 8. The supply plate 25 is a metal plate which has holes each for connecting an aperture 12 for one pressure chamber 10 of the cavity plate 22 to a corresponding sub manifold 5*a*, and holes each for connecting the pressure chamber 10 to a corresponding nozzle 8. The manifold plates 26, 27 and 28 are metal plates which have the sub manifolds 5*a*, and holes each for connecting one pressure chamber 10 of the cavity plate 22 to a corresponding nozzle 8. The cover plate 29 is a metal plate which has holes each for connecting one pressure chamber 10 of the cavity plate 22 to a corresponding nozzle 8. The nozzle plate 30 is a metal plate which has nozzles 8 each provided for one pressure chamber 10 of the cavity plate 22.

Generally, an adhesive agent is used for bonding the metal plates 22 to 30 to one another to thereby laminate the metal plates 22 to 30. In this case, it is necessary to provide escape grooves for making the adhesive agent escape to prevent the individual ink flowpaths 32 from being blocked with the adhesive agent entering the connection holes 14, etc. constituting the individual ink flow paths 32 formed in the metal plates. Therefore, particularly the metal plates 22 to 25 each having a large number of holes may be bonded to one another by means of metal bonding such as diffusion bonding. In this case, because there is no adhesive agent used, escape grooves for making the adhesive agent escape need not be formed in the metal plates 22 to 25. Accordingly, the connection holes 14, etc. constituting the individual ink flow paths 32 can be arranged as adjacently as possible. In this manner, the sub manifolds 5*a* can be further widened because the connection holes 14, the ink inlets 16, etc. can be arranged as adjacently as possible.

The ten sheets 21 to 30 are laminated to one another while positioned so that the individual ink flow paths 32 are formed as shown in FIG. 6. That is, each individual ink flow path 32 first goes upward from the sub manifold 5*a*, extends horizontally in the aperture 12, goes further upward from the aperture 12, extends horizontally again in the pressure chamber 10, goes obliquely downward in the direction of departing from the aperture 12 for a while and goes vertically downward to the nozzle 8.

Next, the configuration of the actuator unit 21 laminated on the cavity plate 22 as the uppermost layer of the flow path unit 4 will be described.

Figure 8A:
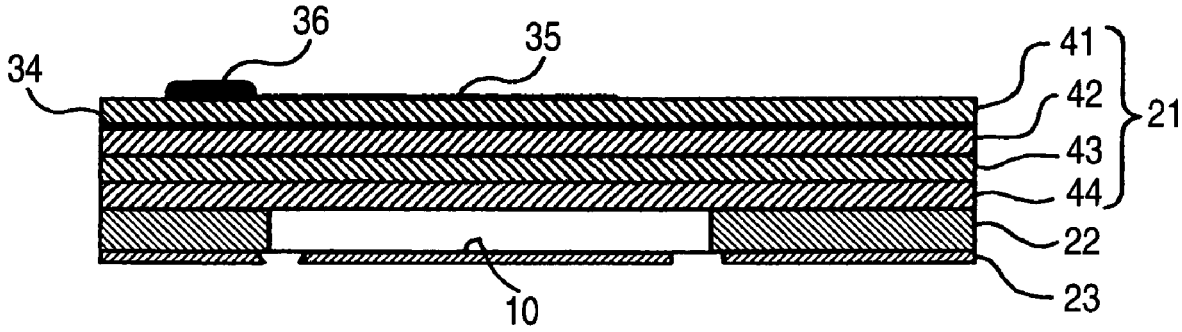
FIG. 8A is a sectional view showing an actuator unit.

As shown in FIG. 8A, the actuator unit 21 includes four piezoelectric sheets 41, 42, 43 and 44 formed to have a thickness of about 15.m equally. The piezoelectric sheets 41 to 44 are provided as stratified flat plates (continuous flat plate layers) which are continued to one another so as to be arranged over a large number of pressure chambers 10 formed in one ink ejection region in the head body 70. Because the piezoelectric sheets 41 to 44 are arranged as continuous flat plate layers over the large number of pressure chambers 10, the individual electrodes 35 can be disposed densely on the piezoelectric sheet 41 when, for example, a screen printing technique is used. Accordingly, the pressure chambers 10 formed in positions corresponding to the individual electrodes 35 can be also disposed densely, so that a high-resolution image can be printed. Each of the piezoelectric sheets 41 to 44 is made of a ceramic material of the lead zirconate titanate (PZT) type having ferroelectricity.

The individual electrodes 35 are formed on the piezoelectric sheet 41 as the uppermost layer. A common electrode 34 having a thickness of about 2.m is interposed between the piezoelectric sheet 41 as the uppermost layer and the piezoelectric sheet 42 located under the piezoelectric sheet 41 so that the common electrode 34 is formed on the whole surface of the piezoelectric sheet 42. The individual electrodes 35 and the common electrode 34 are made of a metal material such as Ag—Pd.

Figure 8B:
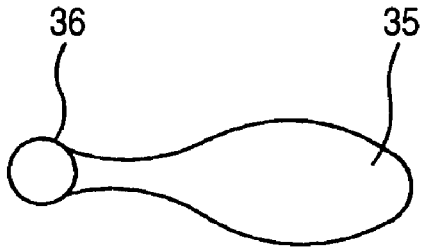
FIG. 8B is a plan view showing an individual electrode.

As shown in FIG. 8B, each individual electrode 35 has a thickness of about 1.m and has a nearly rhomboid planar shape nearly similar to the shape of the pressure camber 10 shown in FIG. 5. An acute-angled portion of each nearly rhomboid individual electrode 35 extends. A circular land portion 36 having a diameter of about 160.m is provided at an end of the extension of the acute-angled portion of the individual electrode 35 so as to be electrically connected to the individual electrode 35. For example, the land portion 36 is made of gold containing glass frit. As shown in FIG. 8A, the land portion 36 is bonded onto a surface of the extension of the individual electrode 35.

The common electrode 34 is grounded to a region not shown. Accordingly, the common electrode 34 is kept at ground potential equally in regions corresponding to all the pressure chambers 10. The individual electrodes 35 are connected to the driver IC 80 through the FPC 50 including independent lead wires in accordance with the individual electrodes 35 so that electric potential can be controlled in accordance with each pressure chamber 10 (see FIGS. 1 and 2).

Next, a drive method of the actuator unit 21 will be described. The direction of polarization of the piezoelectric sheet 41 in the actuator unit 21 is a direction of the thickness of the piezoelectric sheet 41. That is, the actuator unit 21 has a so-called unimorph type structure in which one piezoelectric sheet 41 on an upper side (i.e., far from the pressure chambers 10) is used as a layer including an active layer while three piezoelectric sheets 42 to 44 on a lower side (i.e., near to the pressure chambers 10) are used as non-active layers. Accordingly, when the electric potential of an individual electrode 35 is set at a predetermined positive or negative value, an electric field applied portion of the piezoelectric sheet 41 put between electrodes serves as an active layer (pressure generation portion) and shrinks in a direction perpendicular to the direction of polarization by the transverse piezoelectric effect, for example, if the direction of the electric field is the same as the direction of polarization. On the other hand, the piezoelectric sheets 42 to 44 are not affected by the electric field, so that the piezoelectric sheets 42 to 44 do not shrink spontaneously. Accordingly, a difference in distortion in a direction perpendicular to the direction of polarization is generated between the piezoelectric sheet 41 on the upper side and the piezoelectric sheets 42 to 44 on the lower side, so that the whole of the piezoelectric sheets 41 to 44 is to be deformed so as to be curved convexly on the non-active side (unimorph deformation). On this occasion, as shown in FIG. 8A, the lower surface of the whole of the piezoelectric sheets 41 to 44 is fixed to the upper surface of the partition wall (cavity plate) 22 which partitions the pressure chambers. As a result, the piezoelectric sheets 41 to 44 are deformed so as to be curved convexly on the pressure chamber side. For this reason, the volume of the pressure chamber 10 is reduced to increase the pressure of ink to thereby eject ink from a nozzle 8 connected to the pressure chamber 10. Then, when the electric potential of the individual electrode 35 is returned to the same value as the electric potential of the common electrode 34, the piezoelectric sheets 41 to 44 are restored to the original shape so that the volume of the pressure chamber 10 is returned to the original value. As a result, ink is sucked from the manifold 5 side.

Incidentally, another drive method maybe used as follows. The electric potential of each individual electrode 35 is set at a value different from the electric potential of the common electrode 34 in advance. When ever there is an ejection request, the electric potential of the individual electrode 35 is once changed to the same value as the electric potential of the common electrode 34. Then, the electric potential of the individual electrode 35 is returned to the original value different from the electric potential of the common electrode 34 at predetermined timing. In this case, the piezoelectric sheets 41 to 44 are restored to the original shape at the timing when the electric potential of the individual electrode 35 becomes equal to the electric potential of the common electrode 34. Accordingly, the volume of the pressure chamber 10 is increased compared with the initial state (in which the common electrode 34 and the individual electrode 35 are different in electric potential from each other), so that ink is sucked from the manifold 5 side into the pressure chamber 10. Then, the piezoelectric sheets 41 to 44 are deformed so as to be curved convexly on the pressure chamber 10 side at the timing when the electric potential of the individual electrode 35 is set at the original value different from the electric potential of the common electrode 34 again. As a result, the volume of the pressure chamber 10 is reduced to increase the pressure of ink to thereby eject ink.

According to the aforementioned inkjet head, the following effect can be obtained.

First and second pressure chamber columns 11*a* and 11*b* are arranged alternately in a plane in which pressure chambers 10 are arranged in the form of a matrix. Pressure chambers 10*a* as constituent members of a first pressure chamber column la and pressure chambers 10*b* as constituent members of a second pressure chamber column 11*b* adjacent to the first pressure chamber column 11*a* are arranged opposite to one sub manifold 5*a*. Accordingly, the difference in compliance between the pressure chambers 10*a* and 10*b* constituting the first and second pressure chamber columns 11*a* and 11*b* can be reduced at the time of ejecting ink from nozzles 8. Accordingly, ink ejection characteristic can be made uniform when ink is ejected from nozzles 8 connected to the pressure chambers 10*a* and 10*b* respectively.

Moreover, configuration is made so that one sub manifold 5*a* supplies ink to only the pressure chambers 10*a* and 10*b* constituting the two pressure chamber columns 11*a* and 11*b*. Accordingly, the density of ink outlets 18 for taking ink out of the sub manifold 5*a* or the density of apertures 12 connected to the ink outlets 18 can be relaxed compared with the case where one sub manifold 5*a* supplies ink to a large number of pressure chamber columns. Accordingly, the degree of freedom on design for arranging the ink outlets 18, apertures 12, etc. can be improved. In addition, when ink is ejected from a nozzle 8 connected to one pressure chamber 10, the influence of pressure change of the sub manifold 5*a* on ink ejection characteristic of another pressure chamber 10, that is, so-called crosstalk can be reduced.

First connection holes 14*a* of the first pressure chamber column 11*a* and second connection holes 14*b* of the second pressure chamber column 11*b* are arranged side by side in the first direction on opposite sides of the sub manifold 5*a* when viewed from the third direction. The first connection holes 14*a* and the second connection holes 14*b* partially overlap each other between two adjacent sub manifolds 5*a* when viewed from the first direction. The first connection holes 14*a* and the second connection holes 14*b* are substantially arranged on a column in the first direction. First ink flow paths 15*a* of the first pressure chamber column 11*a* and second ink flow paths 15*b* of the second pressure chamber column 11*b* partially overlap each other when viewed from the first direction. The first ink flow paths 15*a* and the second ink flow paths 15*b* are substantially arranged on a column in the first direction.

According to this configuration, the region occupied by the first and second connection holes 14*a* and 14*b* (first and second ink flow paths 15*a* and 15*b*) can be made as narrow as possible in the second direction to reduce the distance between nozzles 8 in the second direction to thereby widen the sub manifolds 5*a* when viewed from the third direction. Accordingly, the flow path area of each sub manifold 5*a* can be made large and flow path resistance can be reduced, so that ink can be smoothly supplied to the pressure chambers 10. Or the height (length in the third direction) of each sub manifold 5*a* can be reduced as the sub manifold 5*a* is widened. Accordingly, the size of the inkjet head 1 can be reduced or the number of metal plates 26 to 28 used for forming the sub manifolds 5*a* can be reduced.

Moreover, first ink inlets 16*a* of the first pressure chamber column 11*a* and second ink inlets 16*b* of the second pressure chamber column 11*b* are arranged side by side and opposite to nozzles 8 connected to corresponding pressure chambers 10*a* and 10*b* when viewed from the third direction. The first ink inlets 16*a* and the second ink inlets 16*b* partially overlap each other when viewed from the first direction. The first ink inlets 16*a* and the second ink inlets 16*b* are substantially arranged on a column in the first direction in a neighbor of a central portion of the sub manifold 5*a* viewed from the third direction. Accordingly, the distance between nozzles 8 of the first and second pressure camber columns 11*a* and 11*b* disposed on opposite sides of the sub manifold 5*a* can be made large, so that the sub manifold 5*a* disposed between the first and second pressure chamber columns 11*a* and 11*b* can be widened.

Next, a second embodiment of the invention will be described. Parts the same in structure as those of the first embodiment are denoted by reference numerals the same as those of the first embodiment for the sake of omission of duplicated description.

The second embodiment is substantially equal to the first embodiment with respect to the arrangement of pressure chambers 10, nozzles 8 and sub manifolds 5*a* but different from the first embodiment with respect to a configuration for supplying ink from the sub manifolds 5*a* to the pressure chambers 10.

Figure 9:
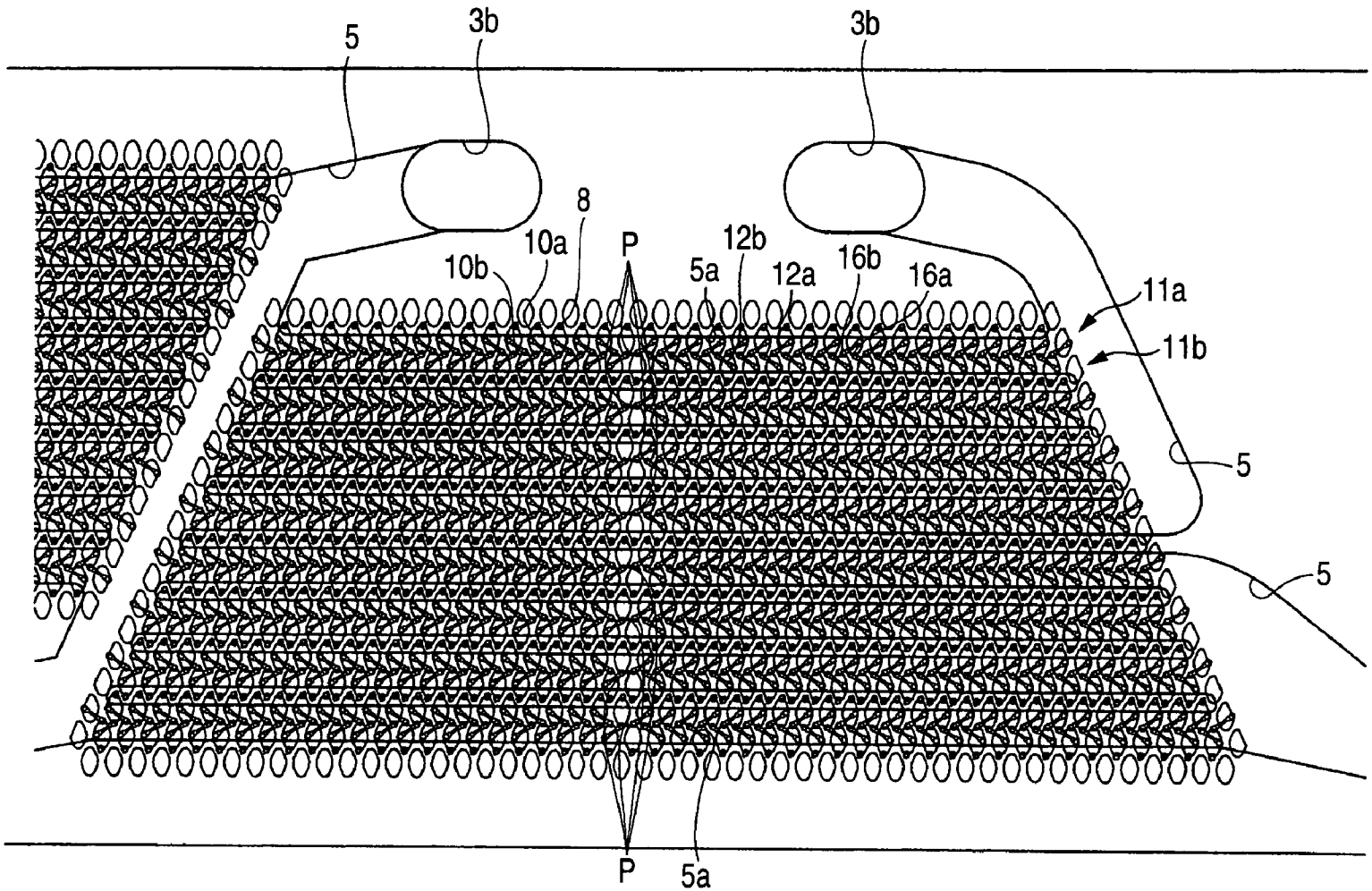
FIG. 9 is a partially enlarged view of a head body according to a second embodiment of the invention.

As shown in FIG. 9, pressure chambers 10*a* constituting a first pressure chamber column 11*a* and pressure chambers 10*b* constituting a second pressure chamber column 11*b* are arranged opposite to one sub manifold 5*a*. Configuration is made so that one sub manifold 5*a* supplies ink to the pressure chambers 10*a* and 10*b* of the two pressure chamber columns 11*a* and 11*b*. Ink flows from left and right sides of each sub manifold 5*a*.

Figure 10:
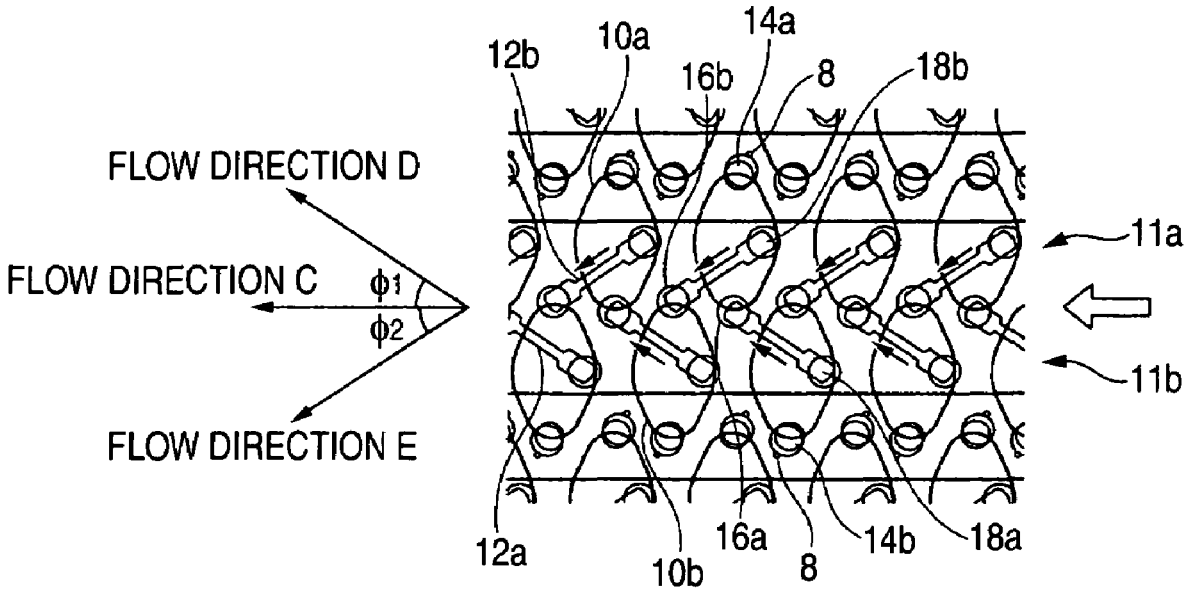
FIG. 10 is a partially enlarged view of FIG. 9.

The sub manifold 5*a* supplies ink to pressure chambers 10 through apertures 12 (12*a* and 12*b*) and ink inlets 16 (16*a* and 16*b*). As shown in FIG. 10, first apertures 12*a* connected to pressure chambers 10*a* constituting a first pressure chamber column 11*a* and second apertures 12*b* connected to pressure chambers 10*b* constituting a second pressure camber column 11*b* are inclined at acute angles.1 and .2 respectively with respect to the direction C of flow of ink in the sub manifold 5*a*. That is, ink is supplied to pressure chambers 10*a* of the first pressure chamber column 11*a* along the flow direction D inclined upward at an acute angle.1 with respect to the flow direction C in FIG. 10 while ink is supplied to pressure chambers 10*b* of the second pressure chamber column 11*b* along the flow direction E inclined downward at an acute angle.2 with respect to the flow direction C in FIG. 10. The first apertures 12*a* and the second apertures 12*b* are formed symmetrically with respect to points in the central position P of the sub manifold 5*a*.

According to this configuration, ink smoothly flows from the sub manifold 5*a* to the pressure chambers 10. Accordingly, ink can be smoothly supplied to the pressure chambers 10. Moreover, air mixed with ink in the sub manifold 5*a* smoothly flows into the pressure chambers 10. Accordingly, air reserved in the inside of the sub manifold 5*a*, apertures 12, etc. can be discharged easily. Incidentally, it is preferable from structural symmetry that the acute angles .1 and .2 are substantially equal to each other. In this case, the pressure chambers 10*a* of the first pressure chamber column 11*a* and the pressure chambers 10*b* of the second pressure chamber column 11*b* can be made uniform with respect to ink supply characteristic and mixed air discharge characteristic.

What is claimed is:

1. An inkjet head comprising:

a flow path unit including;

plural nozzles which ejects ink;

plural pressure chambers having ends connected to the nozzles respectively, which are arranged in a form of a matrix along a plane to thereby form pressure chamber columns in a first direction in the plane, the plural pressure chambers including;

first pressure chamber columns, each including pressure chambers having the nozzles unevenly distributed on one side of a second direction crossing the first direction and first connection holes connected to the nozzles respectively; and second pressure chamber columns, each including pressure chambers having the nozzles unevenly distributed on the other side of the second direction and second connection holes connected to the nozzles respectively; and plural common ink paths extending along the first direction and connected to the pressure chambers through ink inlets respectively, wherein the first and second pressure chamber columns are arranged alternately in the plane, such that each of a plurality of first pressure chamber columns is located immediately next to, and between, two second pressure chamber columns, and each of a plurality of second pressure chamber columns is located immediately next to, and between, two first pressure chamber columns, two pressure chamber columns are arranged opposite to each of the common ink paths and configured by one of the first pressure chamber columns and one of the second pressure chamber columns which are adjacent with each other, the first connection holes and the second connection holes are arranged side by side in the first direction on opposite sides of a corresponding common ink path when viewed from a third direction perpendicular to the plane, and the first connection holes and the second connection holes are arranged and at least partially overlapped each other between two adjacent common ink paths when viewed from the first direction.

2. An inkjet head according to claim 1, wherein the first connection holes and the second connection holes are arranged on one column in the first direction between the two adjacent common ink paths.

3. An inkjet head according to claims 1, wherein the direction of flow of ink supplied from the common ink path to the pressure chambers is inclined at an acute angle with respect to the direction of flow of ink in the common ink path when viewed from the third direction.

4. An inkjet head according to claim 1, wherein the pressure chambers and the common ink paths are connected to each other through apertures extending in parallel to the plane, and each of the common ink paths is formed so that first apertures connected to pressure chambers of the first pressure chamber columns and second apertures connected to pressure chambers of the second pressure chamber columns are arranged symmetrically with respect to points when viewed from the third direction.

5. An inkjet head according to claim 1, wherein a width of each common ink path is larger than a distance between adjacent common ink paths in the second direction.

6. An inkjet head comprising:

a flow path unit including;

plural nozzles which ejects ink;

plural pressure chambers having ends connected to the nozzles respectively and arranged in the form of a matrix along a plane to thereby form pressure chamber columns in the first direction in the plane; and plural common ink paths extending along the first direction and connected to the pressure chambers through plural ink inlets respectively, wherein the pressure chamber columns include first pressure chamber columns each configured by pressure chambers having nozzles unevenly distributed on one side of a second direction crossing the first direction and second pressure chamber columns each configured by pressure chambers having nozzles unevenly distributed on the other side of the second direction, the first and second pressure chamber columns are arranged alternately in the plane, such that each of a plurality of first pressure chamber columns is located immediately next to, and between, two second pressure chamber columns, and each of a plurality of second pressure chamber columns is located immediately next to, and between, two first pressure chamber columns, two adjacent pressure chamber columns are configured by a combination of one of the first pressure chamber columns and one of the second pressure chamber columns which are arranged opposite to each of the common ink paths, plural nozzles connected to pressure chambers of the first pressure chamber columns and plural nozzles connected to pressure chambers of the second pressure chamber columns are arranged side by side in the first direction on opposite side of corresponding common ink paths when viewed from a third direction perpendicular to the plane; and first ink flow paths connecting the pressure chambers of the first pressure chamber columns to the nozzles respectively and second ink flow paths connecting the pressure chambers of the second pressure chamber columns to the nozzles respectively are arranged and at least partially overlapped each other between two adjacent common ink paths when viewed from the first direction.

7. An inkjet head according to claim 6, wherein the first ink flow paths and the second ink flow paths are arranged on one column in the first direction between the two adjacent common ink paths.

8. An inkjet head according to claim 6, wherein a width of each common ink path is larger than a distance between adjacent common ink paths in the second direction.

9. An inkjet head comprising:

a flow path unit including;

plural nozzles which ejects ink;

plural pressure chambers having ends connected to the nozzles respectively and arranged in the form of a matrix along a plane to thereby form pressure chamber columns in a first direction in the plane; and plural common ink paths extending along the first direction and connected to the pressure chambers through ink inlets respectively, wherein the pressure chamber columns include first pressure chamber columns each configured by pressure chambers having nozzles unevenly distributed on one side of a second direction crossing the first direction, and second pressure chamber columns each configured by pressure chambers having nozzles unevenly distributed on the other side of the second direction, the first and second pressure chamber columns are arranged alternately in the plane, such that each of a plurality of first pressure chamber columns is located immediately next to, and between, two second pressure chamber columns, and each of a plurality of second pressure chamber columns is located immediately next to, and between, two first pressure chamber columns, two adjacent pressure chamber columns configured by a combination of a first pressure chamber column and a second pressure chamber column are arranged opposite to each common ink path, plural first ink inlets formed in the pressure chambers of the first pressure chamber columns and plural second ink inlets formed in the pressure chambers of the second pressure chamber columns are arranged side by side and opposite to nozzles connected to corresponding pressure chambers when viewed from a third direction perpendicular to the plane, and each of the common ink paths is formed so that the first ink inlets of the first pressure chamber columns and the second ink inlets of the second pressure chamber columns are arranged and partially overlapped each other in a neighbor of a central portion of the common ink paths viewed from the third direction when viewed from the first direction.

10. An inkjet head according to claim 9, wherein each of the common ink paths is formed so that the first ink inlets and the second ink inlets are arranged on one column in the first direction in a neighbor of a central portion of the common ink paths viewed from the third direction.

11. An inkjet head according to claim 9, wherein a width of each common ink path is larger than a distance between adjacent common ink paths in the second direction.

12. An inkjet head comprising:

a flow path unit including;

plural nozzles which ejects ink;

plural pressure chambers having ends connected the nozzles respectively, which are arranged in a form of a matrix along a plane to thereby form pressure chamber columns in a first direction in the plane, the plural pressure chambers including;

first pressure chamber columns, each including pressure chambers having the nozzles unevenly distributed on one side of a second direction crossing the first direction and first connection holes connected to the nozzles respectively; and second pressure chamber columns, each including pressure chambers having the nozzles unevenly distributed on the other side of the second direction and second connection holes connected to the nozzles respectively; and plural common ink paths extending along the first direction and connected to the pressure chambers through ink inlets respectively, wherein the first and second pressure chamber columns are arranged alternately in the plane, such that each of a plurality of first pressure chamber columns is located immediately next to, and between, two second pressure chamber columns, and each of a plurality of second pressure chamber columns is located immediately next to, and between, two first pressure chamber columns, two pressure chamber columns are arranged opposite to each of the common ink paths and configured by one of the first pressure chamber columns and one of the second pressure chamber columns which are adjacent with each other, the first connection holes and the second connection holes are arranged side by side in the first direction on opposite sides of a corresponding common ink path when viewed from a third direction perpendicular to the plane, and a portion where the pressure chambers of the first pressure chamber columns overlap with one of the common ink paths with respect to each of the common ink paths has substantially same area as a portion where the pressure chambers of the second pressure chamber columns overlap with the one of the common ink paths with respect to each of the common ink paths when viewed from a direction which is orthogonal to the plane.

13. An inkjet head according to claim 12, wherein a width of each common ink path is larger than a distance between adjacent common ink paths in the second direction.

14. An inkjet head comprising;

a flow path unit including;

plural nozzles which ejects ink;

plural pressure chambers having ends connected the nozzles respectively, which are arranged in a form of a matrix along a plane to thereby form pressure chamber columns in a first direction in the plane, the plural pressure chambers including;

first pressure chamber columns, each including pressure chambers having the nozzles unevenly distributed on one side of a second direction crossing the first direction and first connection holes connected to the nozzles respectively; and second pressure chamber columns, each including pressure chambers having the nozzles unevenly distributed on the other side of the second direction and second connection holes connected to the nozzles respectively; and plural common ink paths extending along the first direction and connected to the pressure chambers through ink inlets respectively, wherein the first and second pressure chamber columns are arranged alternately in the plane, such that each of a plurality of first pressure chamber columns is located immediately next to, and between, two second pressure chamber columns, and each of a plurality of second pressure chamber columns is located inunediately next to, and between, two first pressure chamber columns, two pressure chamber columns are arranged opposite to each of the common ink paths and configured by one of the first pressure chamber columns and one of the second pressure chamber columns which are adjacent with each other, the first connection holes and the second connection holes are arranged side by side in the first direction on opposite sides of a corresponding common ink path when viewed from a third direction perpendicular to the plane, and a portion where each of the pressure chambers overlaps with each of the common ink paths is larger than a portion where each of the pressure chambers does not overlap with each of the common ink paths.

15. An inkjet head according to claim 14, wherein a width of each common ink path is larger than a distance between adjacent common ink paths in the second direction.

* * * * *